US005197520A

United States Patent [19]

Reimertz

[11] Patent Number: 5,197,520

[45] Date of Patent: Mar. 30, 1993

[54] CLEANING SYSTEM FOR LOOM AIRJET NOZZLE

[75] Inventor: Heinz Reimertz, Heiligenhaus, Fed. Rep. of Germany

[73] Assignee: Picanol, n.v., Belgium

[21] Appl. No.: 762,483

[22] Filed: Sep. 19, 1991

[30] Foreign Application Priority Data

Sep. 20, 1990 [DE] Fed. Rep. of Germany ..... 4029743

[51] Int. Cl.[5] ..... D03J 1/00

[52] U.S. Cl. ..... 139/1 C; 139/435.4; 139/435.5; 239/112; 15/304

[58] Field of Search ..... 68/205 R; 239/106, 112; 15/304; 139/1 C, 435.2, 435.5, 435.4

[56] References Cited

U.S. PATENT DOCUMENTS

| | | | |
|---|---|---|---|
| 3,179,341 | 4/1965 | Plos et al. | 239/112 X |
| 3,348,774 | 10/1967 | Wiggins | 239/112 |
| 3,542,595 | 11/1970 | McCullough et al. | 139/1 C |
| 3,940,063 | 2/1976 | Baumgartner et al. | 239/112 X |
| 4,303,106 | 12/1981 | Yoshida et al. | 139/1 C |
| 4,625,770 | 12/1986 | Ishikawa | 139/435.5 X |
| 4,794,958 | 1/1989 | Maes et al. . | |

*Primary Examiner*—Andrew M. Falik
*Attorney, Agent, or Firm*—Bacon & Thomas

[57] ABSTRACT

An airjet loom is cleaned by periodically passing a cleaning fluid through the airjet nozzles. For this purpose, the solenoid valves each include an additional hook-up by means of which the airjet nozzles can communicate with a source of cleaning liquid.

11 Claims, 1 Drawing Sheet

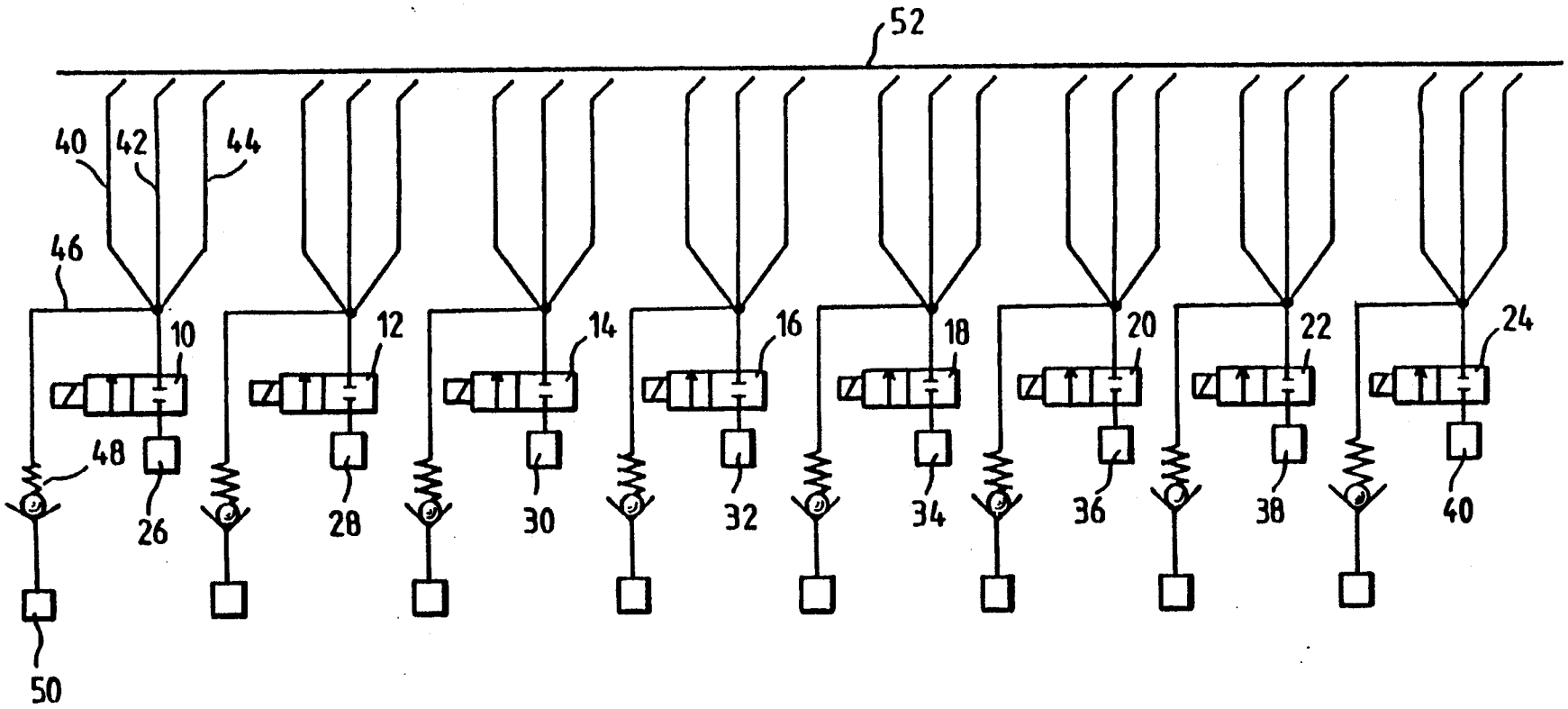
52
24
40
22
38
20
36
18
34
16
32
14
30
12
28
44
10
26
42
48
40
46
50

CLEANING SYSTEM FOR LOOM AIRJET NOZZLE

BACKGROUND OF THE INVENTION

1. Field of the Invention

The invention concerns a method for cleaning airjet nozzles and reeds in airjet looms of the type in which the airjet nozzles are connected to a source of compressed air for accomplishing insertion of the pick. The invention also relates to a system of nozzles with which to implement such a method.

2. Description of the Related Art

In airjet looms, the pick is transported through the shed by means of an air flow. For that purpose, the reed includes a guide duct formed by the reed blades as shown, for example, in U.S. Pat. No. 4,794,958. The pick is inserted through a main nozzle into the guide duct and then is transported further by an airflow generated by relay nozzles toward the opposite selvage. The relay nozzles are loaded consecutively with compressed air through driven solenoid valves. Such airjet looms illustratively are described in a company brochure "PAT W Airtronic" (June 1986) issued by PICANOL N. V. Polenlaan 3-7, B-8900, Ypres, Belgium.

Accurate metering and precise direction of the issuing air is critical in order to satisfactorily operate such airjet looms, and thus the shape and cross-section of the airjet nozzles and guide duct must be carefully controlled. Changes in the nozzle cross-section or flow contour in the guide duct may be caused by settling dust entrained in the compressed air or deposits in the guide duct, resulting in malfunctioning of the airjet loom. Therefore, it is necessary to periodically clean the airjet nozzles and the guide duct. Conventionally, this is done manually, with brushes. Such manual cleaning is complex and unreliable, and may result in damage to parts of the airjet loom.

SUMMARY OF THE INVENTION

It is an object of the invention is to facilitate and improve the cleaning of airjet nozzles and the reed and to avert the danger of damaging machine parts during cleaning.

This object is accomplished, in accordance with a preferred embodiment of the invention, by periodically passing a cleaning fluid through the airjet nozzles for purposes of cleaning, and by providing a nozzle system to implement this procedure.

Cleaning is carried out by forcing the cleaning fluid through the airjet nozzles of the operating loom. This cleaning fluid flushes dust and other particulates out of the airjet nozzles and the guide duct. When the airjet loom is operating, the airjet nozzles and also the reed are "polished" by the warps moving to and fro so that the cleaning fluid and the flushed particulates are removed, whereupon the airjet nozzles and the guide duct will again operate satisfactorily. There is no need to apply a brush to the individual airjet nozzles.

BRIEF DESCRIPTION OF THE DRAWING

An illustrative embodiment of the invention is elucidated below in relation to the associated drawing.

The FIGURE schematically shows a system of airjet nozzles of an airjet loom and the driving solenoid valves, and further a cleaning system for the airjet nozzles and the reed.

DETAILED DESCRIPTION OF THE PREFERRED EMBODIMENTS

The mechanical construction of an airjet loom, with the airjet nozzles, the shed and the reed, is generally known and therefore is not shown herein in detail.

A set of solenoid valves is denoted by 10–24. In known manner, the solenoid valves are driven consecutively. Each solenoid valve 10–24 controls the compressed-air supply from compressed-air hook-ups 26–38 to sets of airjet nozzles mounted in a row along a guide duct 52. Three airjet nozzles 40, 42 and 44 are associated with solenoid valve 10. Each solenoid valve 10–24 is connected through the associated compressed-air hook-ups 26–38 with a source of compressed air.

A hook-up duct 46 taps in between the airjet nozzles 40, 42 and 46 on one hand and the solenoid valve 10 on the other. A check valve 48 is in-line with the hook-up duct 46. The check valve 48 opens toward the airjet nozzles 40, 42 and 44. A source of cleaning fluid, preferably a liquid, can be connected through a hook-up means 50 to the hook-up duct 46. This cleaning-liquid source can be a cleaning-fluid filled container with a manual pump. The manual pump generates an impulse of about five cubic centimeters into the hook-up duct 46. The check valve 48 blocks the compressed air. The cleaning fluid flows through airjet nozzles 40, 42, 44, and through the guide duct, entraining any adhering particles in its path. These particles are flushed toward the outside of the airjet nozzles 40, 42, 44 into the guide duct. During further operation of the airjet loom, the cleaning fluid dissolves the soil in the guide duct and at the reed, and the soil is then stripped by the warps moving up and down.

I claim:

1. A method of cleaning an airjet nozzle and an airjet loom of type in which the airjet nozzle communicates with a source of compressed air in order to cause insertion of a pick, comprising the step of periodically causing a cleaning fluid other than said compressed air which causes insertion of the pick to pass from a source of the cleaning fluid, for purposes of cleaning the airjet nozzle, through the airjet nozzle.

2. A method as claimed in claim 1, wherein the airjet loom includes means including a guide duct for guiding the pick, the pick being inserted through the guide duct, and further comprising the step of causing said cleaning fluid to pass through the guide duct.

3. A method as claimed in claim 1, wherein said airjet nozzle communicates with said source of compressed air by means of a driven valve, and wherein the step of causing the cleaning fluid to pass, for purposes of cleaning, through the airjet nozzle comprises the step of selectively causing said valve to communicate with the source of said cleaning fluid.

4. A method as claimed in claim 1, wherein the step of periodically causing a cleaning fluid to pass comprises the step of periodically causing a cleaning liquid to pass.

5. A nozzle system for an airjet loom, comprising at least one airjet nozzle which selectively communicates by means of at least one driven valve with a source of compressed air to cause insertion of a pick, and means for selectively causing the airjet nozzle to communicate with a source of cleaning fluid other than said compressed air in order to periodically cause the cleaning fluid to pass, for purposes of cleaning the airjet nozzle, through the airjet nozzle.

6. A nozzle system as claimed in claim 5, wherein the airjet loom further comprises means including a guide duct for guiding the pick, and wherein said means for selectively causing the airjet nozzle to communicate with a source of cleaning fluid includes means for causing the guide duct to also communicate with the source of cleaning fluid in order to periodically cause the cleaning fluid to pass, for purposes of cleaning, through both the airjet nozzle and the guide duct.

7. A nozzle system as claimed in claim 5, wherein said cleaning fluid is a liquid.

8. A method of cleaning a pick guide duct in an airjet loom, comprising the steps of providing a source of driving fluid for driving insertion of a pick, providing a source of cleaning fluid in addition to and distinct from the driving fluid, providing means for conveying the cleaning fluid to the guide duct, providing valve means for permitting the cleaning fluid to pass from the cleaning fluid source to the guide duct, and causing the cleaning fluid to periodically pass, for purposes of cleaning, to the guide duct.

9. A method as claimed in claim 8, wherein said cleaning fluid is a liquid.

10. An airjet loom, comprising means including a pick guide duct for guiding a pick, a source of compressed air for driving a pick through the pick guide duct, a cleaning fluid source separate from said compressed air source, means for selectively conveying the cleaning fluid from the cleaning fluid source to the guide duct, means for causing the cleaning fluid to be periodically conveyed by the conveying means from the cleaning fluid source to the guide duct for purposes of cleaning the guide duct.

11. An airjet loom as claimed in claim 10, wherein said cleaning fluid is a liquid.

* * * * *